United States Patent [19]

Heath

[11] Patent Number: 4,502,789

[45] Date of Patent: Mar. 5, 1985

[54] CLOCK

[76] Inventor: Alan L. Heath, 1319 Main Rd., East Eltham, Victoria 3095, Australia

[21] Appl. No.: 525,239

[22] Filed: Aug. 22, 1983

[30] Foreign Application Priority Data

Sep. 14, 1982 [AU] Australia ..... PF5881

[51] Int. Cl.[3] ..... G04B 19/22

[52] U.S. Cl. ..... 368/27; 368/21

[58] Field of Search ..... 368/21–24, 368/27

[56] References Cited

U.S. PATENT DOCUMENTS

| | | | |
|---|---|---|---|
| 557,173 | 3/1896 | Thompson | 368/27 |
| 718,579 | 1/1903 | Pheils | 368/27 |
| 2,070,087 | 2/1937 | McNair | 368/27 |
| 2,128,970 | 9/1938 | Smyser et al. | 368/27 |
| 2,615,298 | 10/1952 | Ferrari | 368/27 |

FOREIGN PATENT DOCUMENTS

| | | | |
|---|---|---|---|
| 95366 | 4/1939 | Switzerland | 368/27 |

*Primary Examiner*—Bernard Roskoski

[57] ABSTRACT

A clock for indicating time for effectively all the countries and time zones of the world, the hour hand of the clock being in the form of a disc that rotates once every twenty-four hours against a twenty-four hour scale. The disc having projected thereon a map of the world centered on the South Pole with the majority of the time zones positioned in accurate longitude around the periphery of the disc. The clock also included indicators for each time zone to provide simple visual indication of the time in any zone or country of the world.

8 Claims, 4 Drawing Figures

CLOCK

FIELD OF THE INVENTION

This invention relates to improvements in or relating to clocks and more particularly to improvements in or relating to clocks that give a visual indication of the times around the world.

BACKGROUND OF THE INVENTION AND PRIOR ART

The world is divided into many time zones. These zones are geographically complex, and are not at all clearly shown by mere longitudinal sector divisions of a circular map. In an age of telecommunication and air travel, determination of the precise time in each country (or parts of) in the world is a considerable problem. Whilst there are a number of charts, scales and clocks which give a correlation of world time, they usually fail in one or more of the aspects of clarity and ease of interpretation by having too many geometric markings, adjacent concentric scales and full size hands, or true positional display through rotation of the time zone disc at other than the correct 24 hour per revolution rate.

In U.S. Pat. No. 2,615,298 the map of the world is positioned on a rotating disc that rotates once every twelve hours. A radially extending pointer is positioned at the periphery of the disc opposite the position of the local country to indicate the local time. A fixed twelve hour scale is positioned on the clock face and an adjacent rotating twenty-four scale is positioned to be visible at the periphery of the disc, the twenty-four scale completing one revolution every twenty-four hours. The minute hand of the clock extends radially across the face of the disc to be read against the stationary twelve hour scale.

Although the clock of U.S. Pat. No. 2,615,298 provides an indication of world time, the fact that the disc rotates every twelve hours makes it impossible to ascertain whether it is night or day or what part of day it is in any particular country without reference to the rotating twenty-four hour scale. Furthermore the comparatively large radially extending minute hand tends to clutter up and confuse the detail of the map of the world and its time zones.

In German offenlegangsschnift No. 3,023,735 a similar clock is disclosed, the hour hand again comprising a disc carrying a visual indication of the map of the world. As in U.S. Pat. No. 2,615,298 the disc rotates once every twelve hours, and the use of large hands defeats clarity.

It is the concern of the present invention to provide a clock that gives, at a casual glance, a clear indication of the time, position of the sun, and part of the day, anywhere in the world whilst also providing a visual indication of local time.

SUMMARY OF THE INVENTION

According to the present invention there is provided a clock for indicating time in effectively all countries and time zones of the world, the clock comprising a timing mechanism and a clock face having thereon an annular scale providing a visual indication of a twenty-four hour clock, said timing mechanism being coupled to a rotatable hour indicator, the hour indicator comprising a disc, the front surface of which carries a projection of the world showing the time zones of the world and indicator means for each zone, the disc being arranged to complete one revolution every twenty-four hours to, in use, provide a visual indication of the hour in any particular time zone of the world by reading the hour on the scale which is radially adjacent the particular zone indicator means.

Preferably the map of the world covers the front surface of the disc except a central portion thereof, the central portion revealing a sixty minute stationary scale and the clock mechanism having a minute hand that in use rotates above said scale.

In a preferred embodiment the map of the world that is superimposed on the disc is centered at the South pole and the countries and time zones of the world are geographically displayed in accurate longitude but adjusted latitude to ensure geographical recognition of particular countries.

Preferably the zone indicator means are positioned exactly around the periphery of the disc so that where time zones are adjacent the periphery, each zone indicator is superimposed on the particular zone and where a time zone is radially inside the periphery, the indicator provides the same visual indication as that time zone.

DESCRIPTION OF THE DRAWINGS

The present invention will now be described by way of example only with reference to the accompanying drawings in which.

DESCRIPTION OF PREFERRED EMBODIMENT

Figure 1:
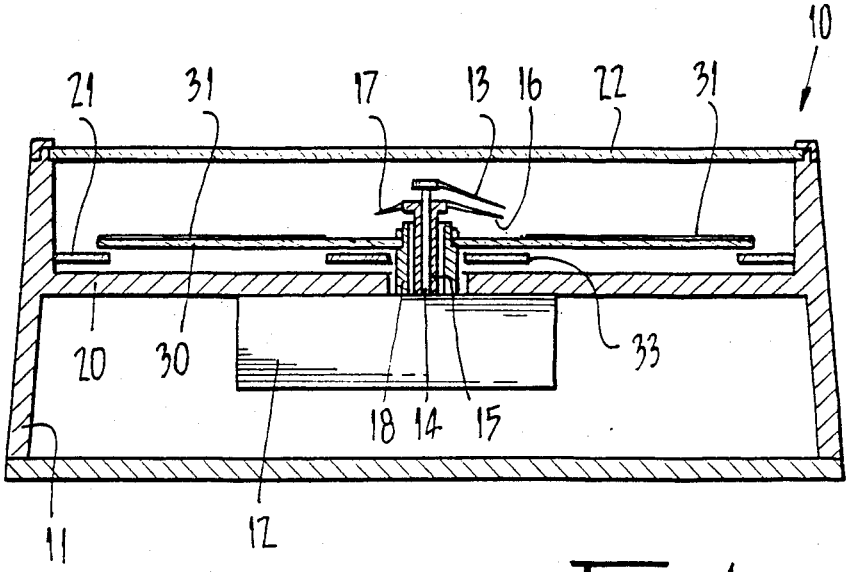
FIG. 1 is a cross-sectional view of a clock in accordance with the present invention.
Figure 2:
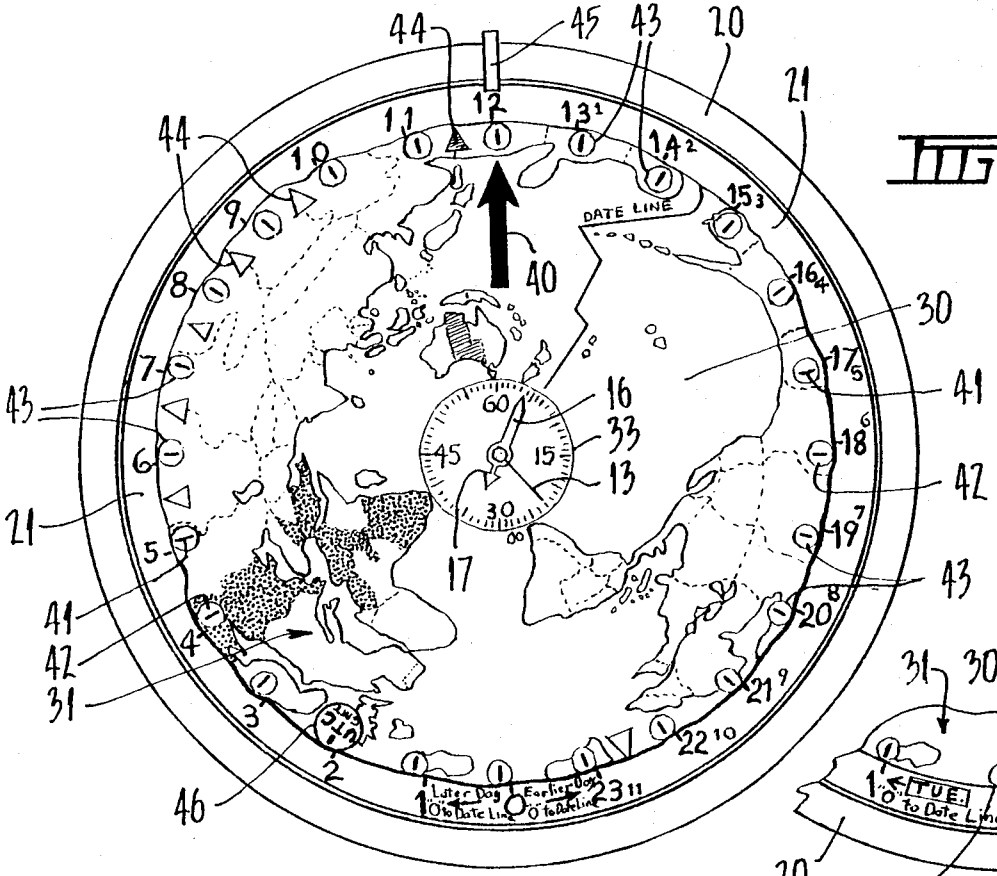
FIG. 2 is a plan view of the face of the clock illustrated in FIG. 1.

A clock 10 as illustrated in FIGS. 1 and 2 comprises a substantially circular casing 11 having located therein a clock movement 12 in a form of a conventional clockwork or electrically driven movement having projecting therefrom a shaft 14 which drives a second hand 13, a shaft 15 that drives a double ended minute hand 16 and 17 and a shaft 18 which drives an hour disc. The clock movement is geared so that the second hand and the minute hand shafts 14 and 15 complete one revolution for every sixty seconds and minutes respectively. The hour hand shaft 18 is geared to complete one revolution every twenty-four hours.

Above the clock movement is provided a circular base panel 20, the periphery of which is provided with an annular incremental twenty-four hour scale 21, illustrated in more detail in FIG. 2. The front face of the clock is covered by a suitable sheet of plastics or glass 22.

The hour hand comprises a disc 30. The disc 30 comprises a circular sheet of transparent material such as plastics, this transparency is a key development to permit vision of the stationary minute and second scale 33 mounted centrally underneath the hour disc. The disc is secured to the shaft 18 so that rotation of the shaft causes rotation of the disc. Positioned on the upper surface of the disc 30 is a map of the world 31 specifically designed to give a clear visual indication of the various time zones of the world. This map has a central aperture for viewing the minute and second scale 33 therethrough.

As shown in FIG. 2, the centre of the disc constitutes the South Pole with all of the world projected around this pole with an accurate reflection of the longitudinal positioning of a particular country for accurate time position relating to rotation, but with the latitude of each country adjusted from a true linear projection so that the various countries can be readily identified. The periphery of the disc provides incremental time zone indicators 43 to align with the twenty-four hour scale 21. The use of a multitude of colours to designate the time zones is also utilised to show the different components of the time zones. Where two countries or parts thereof operate on same time zone, they have the same colour. To provide a still further indication of various countries and important cities, it is understood that a suitable printing may be included, highlighting important cities and countries, or other locational entities. The map also includes a visual indiction of the International Date Line.

To indicate the time in each time zone, each zone indicator 43 includes a radially extending pointer 41 positioned within a circle 42 at the correct point in each time zone. It is a comparison of the position of the pointer 41 against the calibrated twenty-four hour scale on the clock that is used to determine the correct hour for each zone. Because some countries of the world operate on half hour time zones, the periphery of the disc is provided with a number of coloured triangles 44, each of which represents and matches in colour a particular half hour time zone.

To determine the exact time in any particular country or zone thereof, the zone indicator 43 that lies within, or corresponds to the colour of the particular zone is selected and the pointer 41 is read off the twenty-four hour scale. Should the pointer be positioned between two hours, the exact minutes can be read off the minute hand 16 as in ordinary clocks. In the event that there is a half hour time zone involved, the correct half hour indicator triangle 44 should be selected and the smaller triangular minute hand 17 should be read. It will be noted from FIG. 2 that the smaller hand 17 is disposed thirty minutes away from the larger minute hand 16. To aid the sense of solar day time the hours 6–17 are printed in sunlight representing colour of orange or red, in contrast to the other hours that are printed in black.

An attachable pointer 40 may be positioned radially aligned with the particular time zone in which the clock is used. Consequently, as can be seen from FIG. 2, where the clock is to be used in the Eastern States of Australia, the radially extending pointer 40 is positioned on the same line as the radially extending line that extends through the pointer 41 representing the time zone of the Eastern States of Australia. In this way, the clock can more readily be used as a normal clock to determine the local time. The pointer 40 is arranged to be displaceable so that the clock can be used in any country of the world.

Figure 4:
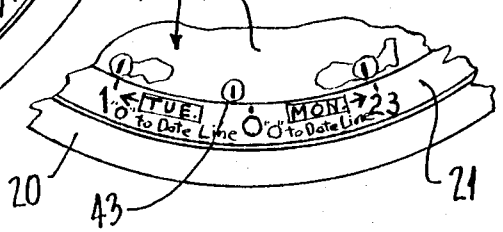
FIG. 4 is a partial view of the clock face illustrated in FIG. 2.

In use, the clock provides a simple and effective visual indication of the time in any particular country or zone of the world, by simply finding the country on the map and reading the time adjacent the time zone pointer for that particular country or zone together with a consideration of the minutes and seconds hand. This way the precise time in any particular part of the world can be determined. By observing the position of the Date Line in relation to the "O" (Midnight) calibration, it is also possible to determine the day on which the time is indicated. This is accomplished by visually sweeping clockwise from midnight "O" to the Date Line. This area is the later of the ever present two days (e.g. say Tuesday). By sweeping visually anticlockwise from "O" to the Date Line, the part of the world is covered where it is the earlier of the two days (e.g. Monday). This technique applies at all times and is very easily learnt. The clock may be equipped with an aperture on each side of the midnight "O" point of the hour scale, in which is automatically displayed the appropriate day (FIG. 4). This display of days is advanced mechanically or electrically as the Date Line crosses midnight or "O".

All times read from the clock described above provide an indication of local time related to the Universal Time Coordinate or Greenwich Mean Time. Where countries utilise times such as "summer time" and other specialised variations that vary depending on the particular seasonal considerations, a separate chart could be consulted or the clock can be supplied with provision for attachable markers, showing the local adjustment which, if it were important, could be kept up to date on the clock. The reason for the special technique is the large discrepancy between the start and finish of "summer time" of various countries. This discrepancy is also caused by political considerations at any time which are not capable of compensation by the mechanism of a clock. The clock could be supplied with detachable updated hour discs which would be produced for summer and winter use.

Figure 3:
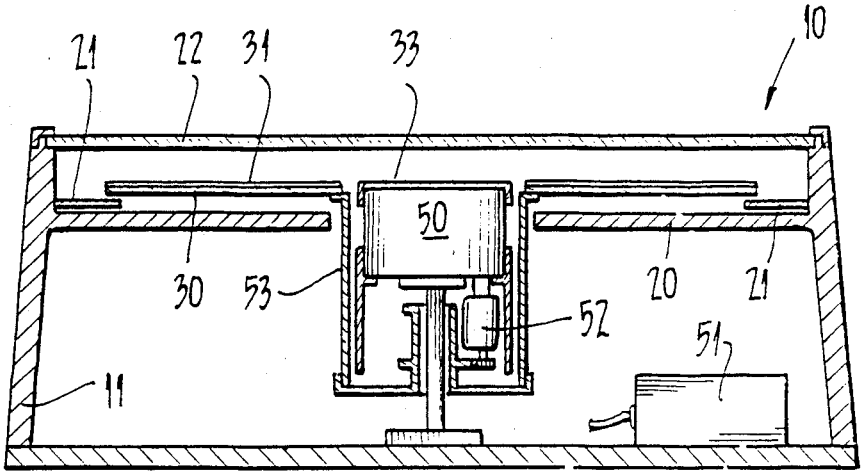
FIG. 3 is a cross-sectional view of an alternate form of clock.

In FIG. 3, there is illustrated a variation to the clock illustrated in FIG. 1 in that instead of a conventional clock movement, a solid state movement 50 is provided operable on a battery 51 to provide a digital or analogue display of the minutes and seconds. However, it is understood that the rotating hour disc 30 is still driven by a stepper motor 52 via a shaft 53 which rotates once every twenty-four hour. It is further understood that a solid state digital display may be used to provide an indication of date changes.

The design and operation of the clock movement is considered well understood by those skilled in the art and does not form an essential part of the present invention.

The important feature of the present invention is the design of the disc shaped hour hand having a projection of the world centered on the South Pole to provide a latitude adjusted but exact longitude projection of the world throughout the various time zones. The use of a variety of colours provides a simple visual indication of the different time zones and countries or parts thereof on the same time zones without any confusing geometric markings, with each time zone having its own pointer or indicator to be checked against the twenty-four hour scale. This clock provides not only a simple and most effective indication of a time anywhere in the world but provides an educational aid in respect of the geography and time zones of the world. The use of a disc that rotates every twenty-four hours together with the use of colours for the various time zones provides not only an exact and easily read indication of the time anywhere in the world but provides a ready indication of the earth's position relative to the sun i.e. midday (straight up), midnight (straight down), dawn (centre left) and sunset (centre right). Whilst the drawings accompanying this application do not illustrate colours an example of the visual indication of one time zone, is illustrated by the use of dots. A number of countries in middle Europe and Africa all having the same time zone are covered in fine dots, the time indicator on the periphery of the disc within the dotted zone is read against the scale and in this example, rests between four and five a.m. A half hour zone (Central Australia) is also illustrated by hatching. A triangular indicator 44 is positioned exactly on the periphery of the disc and is similarly hatched to match up with the Central Australian zone. It is envisaged that a clock of the kind described above would be particularly useful to people such as radio operators, telex users and telephonists who have to frequently make international calls, also educators and in schools, airports, etc. Frequent use of the clock should provide such persons with a visual picture of how the world is divided into time zones together with an improved geographic awareness. A picture that would not be gleaned from the use of complicated and difficult to interpret clocks or tables. The clock face also has the advantage that it can be read by persons of any language by providing a colour coded visual indication of the world without resorting to the use of the written language. The concept would be usable in any size from a small watch to a very large wall unit.

Further variations include specially hatched or lined versions to accommodate the colour blind. It is understood that the variety of colours may vary and that other techniques such as shading or highlighting may be incorporated into the rotating clock face to provide a still further indication of time in any country of the world. Although in a preferred embodiment a single pointer is utilised to indicate local time, it is understood that other different coloured positionable pointers may be incorporated to provide an easier indication of various times to suit a user's priorities.

The clock has a larger indicator printed on the zone (hour) disc to permanently indicate Universal Time (G.M.T.) 46.

To facilitate finding the time at one zone at a particular time at another zone the clock may be equipped with a hand rotatable twenty-four hour scale operated by knob 45. By appropriate temporary positioning of the twenty-four hour scale the answer is quickly found.

Variants of the clock could be made with markings on the disc to suit any special users i.e. Radio zones, Aircraft zones and routes.

Having now described my invention, what is claimed is:

1. A clock for indicating time in effectively all countries and time zones of the world, the clock comprising a timing mechanism and a clock face having thereon an annular scale providing a visual indication of a twenty four hour clock, the timing mechanism being coupled to a rotatable hour indicator, the hour indicator comprising a disc, the front surface of which carries a special projection of the world showing the time zones of the world and indicator means for each zone, the projection of the world covering the front surface of the disc except a transparent central portion that reveals a minute indicator means, the special projection of the world being centred at the south pole and the countries and time zones of the world being geographically presented in accurate longitude but adjusted latitude to ensure geographical recognition of countries, each time zone of the world being visually differentiated by use of colours and the projection of the world being substantially free of geometric markings; whereby the disc is arranged to complete one revolution every twenty four hours to in use provide a visual indication of the time in any particular time zone of the world by reading the hour on the scale which is radially adjacent to the particular zone indicator means and determining the exact time from the minute indicator means.

2. The clock according to claim 1 wherein the minute indicator means comprises a stationery sixty minute scale positioned centre the transparent central portion of the disc and a minute hand coupled to the clock mechanism that sweeps the sixty minute scale.

3. The clock according to claim 1 wherein the minute indicator means comprises a digital indicator driven by the clock mechanism and positioned under the transparent central portion of the disc.

4. The clock according to claim 2 wherein the minute hand is provided with pointers at opposite ends so that the pointers provide indication of time thirty minutes apart, the disc having mounted on its periphery indication means corresponding to one of the pointers to reflect half hour time zones.

5. The clock according to claim 1 wherein the zone indicator means are positioned exactly around the periphery of the disc so that where time zones are adjacent the periphery, each zone indicator is superimposed on the particular zone and where a time zone is radially inside the periphery, the indicator provides the same visual indication as that time zone.

6. The clock according to claim 1 wherein one or more attachable pointers may be positioned radially of the disc adjacent its periphery to provide a visual indication of the time in a particular zone.

7. The clock according to claim 1 wherein means is provided to indicate a day change adjacent the Date Line.

8. The clock according to claim 1 wherein means is provided to rotate the 24 hour scale to provide a simple indication of what the time would be at one zone at a selected time at another zone.

* * * * *